United States Patent [19]

Fogliani

[11] Patent Number: 4,817,956

[45] Date of Patent: Apr. 4, 1989

[54] GAME PLAYING MOVE SELECTOR AND GAME APPARATUS

[76] Inventor: Umberto C. Fogliani, 873 Canning Highway, Mt. Pleasant, Western Australia, Australia

[21] Appl. No.: 24,148

[22] Filed: Mar. 10, 1987

[51] Int. Cl.[4] ..... A63B 71/00; A63F 3/00

[52] U.S. Cl. ..... 273/246; 273/142 JB

[58] Field of Search ..... 273/142 JB, 143, 246, 273/247, 142 J

[56] References Cited

U.S. PATENT DOCUMENTS

| | | | |
|---|---|---|---|
| 1,467,912 | 9/1923 | Atkins | 273/247 |
| 2,001,330 | 5/1935 | McKeever | 273/142 J |

FOREIGN PATENT DOCUMENTS

| | | | |
|---|---|---|---|
| 495506 | 8/1953 | Canada | 273/246 |
| 194020 | 3/1923 | United Kingdom | 273/142 JB |

*Primary Examiner*—Richard C. Pinkham
*Assistant Examiner*—Benjamin Layno
*Attorney, Agent, or Firm*—Steele, Gould & Fried

[57] ABSTRACT

A move selector for randomly determining the movement of sailboat tokens along a sailboat racing game board. The move selector comprises a disc rotatably mounted within a cylindrical housing. A spindle is mounted on the disc axis for manually rotating the disc. The disc comprises two sets of numerals spaced at angularly equidistant intervals. Each set of numerals has an associated arrow on the disc which extends radially from the disc axis. A mask positioned over the disc has a plurality of windows and an arrow adjacent each window pointing radially away from the disc axis. The windows are spaced at angularly equidistant intervals such that when the rotating disc comes to a stop only one set of numerals and its associated arrow is visible through the windows. The associated arrow determines the wind direction. The arrows adjacent each window determine the different directions a sailboat token can move and the numerals visible in each window determine the distance a sailboat can move in each respective direction. The magnetic attraction between a circular steel sheet mounted on the underface of the disc and a magnet located below the disc biases the rotating disc to a stop and ensures the alignment of the numerals and arrows with the windows.

5 Claims, 5 Drawing Sheets

GAME PLAYING MOVE SELECTOR AND GAME APPARATUS

BACKGROUND OF THE INVENTION

This invention relates to a game playing move selector and game apparatus.

SUMMARY OF THE INVENTION

In one form the invention resides in a game playing move selector for providing a substantially random selection of two variables comprising a disc bearing two sets of indicia each representing one of the variables said disc being mounted for rotation about a substantially vertical axis, a mask positioned over the disc and having a plurality of windows through which the indicia on the disc may be viewed and biassing means acting on the disc to ensure alignment of a selection of the indicia with the windows.

In another form the invention resides in a game playing move selector for providing a random selection of two variables comprising a disc bearing two sets of indicia which is rotatably mounted below a mask formed with two sets of windows, a first set of windows comprising a first number of windows spaced circumferentially around the mask to overlie the disc, said second set of windows comprising the second number of windows spaced circumferentially around the mask to overlie the mask and being spaced radially from the first set of windows, a first set of indicia on said disc being located to pass below the first set of windows on rotation of the disc, a second set of indicia on said disc located to pass below the second set of windows on rotation of the disc and biassing means is provided whereby when said disc comes to rest a selection of the indicia on the disc are clearly displayed through said windows.

Preferably the biassing means comprises a first element supported adjacent or on the disc and spaced from the axis of the rotation and a plurality of second elements supported on the disc or adjacent the disc respectively and spaced from the axis of rotation said first and second elements being magnetically attractive.

According to another form the invention resides in a game playing apparatus comprising the game playing move selector described above, a game board and at leat one token, said board being defined into a track having a general direction of movement from a starting point to a finishing point which is sub divided into a plurality of movement stations the movement stations defining a number of specific directions of movement between the movement stations, said game playing move selector having a first set of indicia which provide a measure of the number of spaces to be moved by a player in said general direction and a second set of indicia which provide an indication of the specific direction to be moved by a player.

BRIEF DESCRIPTION OF THE DRAWINGS

The invention will be more fully understood in the light of the following description of one specific embodiment. The description is made with reference to the accompanying drawings of which.

DETAILED DESCRIPTION OF THE PREFERRED EMBODIMENTS

Figure 2:
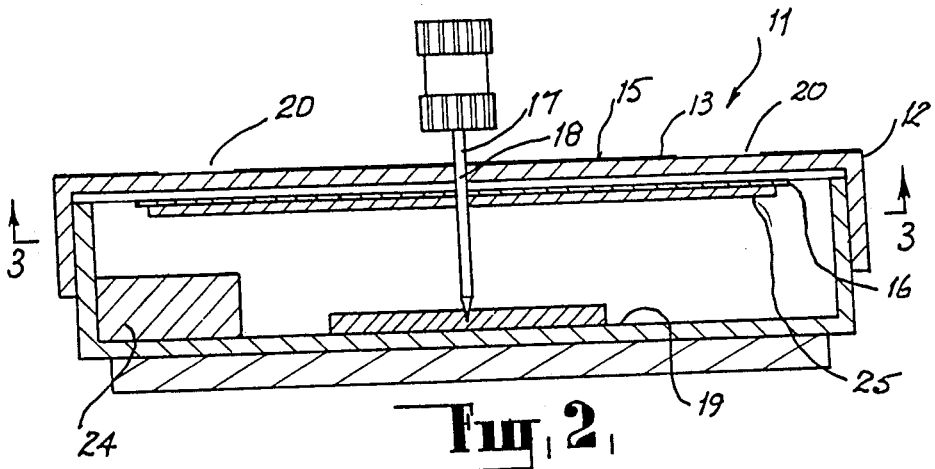
FIG. 2 is a sectional view along the line 2—2 of the game playing move selector of FIG. 1.

The embodiment is directed to a game which simulates the course of a yacht race and comprises a game playing move selector which provides a random selection of movements for a token over a game board.

The game playing move selector 11 of the embodiment comprises a substantially cylindrical housing 12 having a transparent upper face 13 at least some of which is associated with a mask 15 which may lie over the exterior or interior face of the transparent face 13. The interior of the chamber 12 accommodates a circular disc 16 which is rotatably supported within the chamber 12 to rotate underneath the transparent face 13 by means of a spindle 17 supported in a centrally located aperture 18 in the transparent face 13 and on the interior face of the base 19 of the chamber 12.

The mask 15 defines a first set of eight windows 20 which are spaced at angularly equidistant intervals around the central aperture 18. In addition the mask is formed with a second set of windows 21 comprising one window extending between the central aperture 18 and three adjacent windows of the first set of windows 21.

The disc 16 has a first set of indicia 22 comprising a set of sixteen numerals spaced at angularly equidistant intervals around the axis of rotation of the disc 16 whereby the numerals pass below the first set of windows 20. The set of numerals comprise two subsets of numerals wherein each set comprises a symmetrical array of numerals from 0 to 4. A second set of indicia are formed on the disc 16 and comprise two arrow devices 23 which extend radially from the centre axis of rotation of the disc wherein each arrow is angularly offset from the other and each terminates adjacent the corresponding numeral (i.e 14) of each subset of numerals of the first set of indicia 22. The arrows 23 extend radially from the axis of rotation such that they are visible through the second window 21 only. On rotation of the disc 16 only one of the arrows 23 is visible in the second window at any one time.

The chamber 12 supports a magnet 24 at one side while the disc 16 supports on its underface a circular piece of mild steel sheet 25 which is formed with a set of six protrusions 26 on its exterior surface. The magnet 24 is located in the chamber 12 and the protrusions 26 are located on the disc 16 such that after rotation of the disc and on it coming to rest one of the protrusions will be attracted preferentially to the magnet 24 because of its location and as a result of such the disc comes to rest such that a selection of the first set of indicia and one of the arrows of the second set of indicia 22 and 23 are clearly visible through the windows of the mask.

As a result of the construction of the game playing move selector described above on rotation of the disc 16 through the spindle 17 and on the disc coming to rest there will always be clearly displayed at the second window 21 one of the arrows 23 of the second set of indicia and each of the windows of the first set of windows will display one of the numerals of the first set of indicia 22.

The mask is further provided with a set of arrow like indicia 25 located adjacent each of the first windows 20 of which one 25*a* is rendered more visually significant than the others and the arrow like devices 25*b* to each side of the significant arrow like device 25*a* is rendered a little less significant. The more significant arrow like devices 25*a* and 25*b* are located symmetrically about the three windows of the first set of windows which are spanned by the second window 21.

Figure 4:
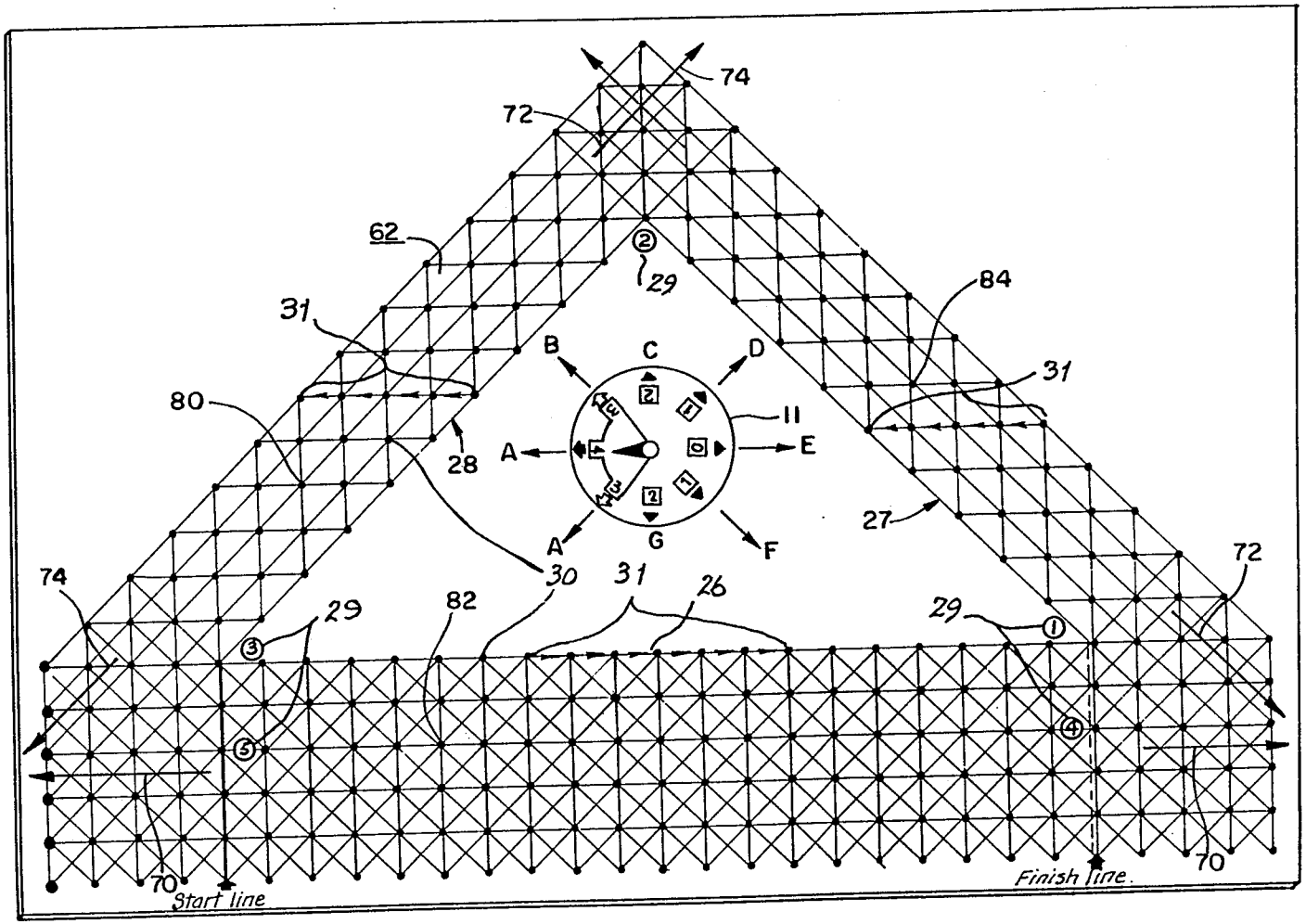
FIG. 4 is a plan view of the game playing board of the embodiment.
Figure 5:
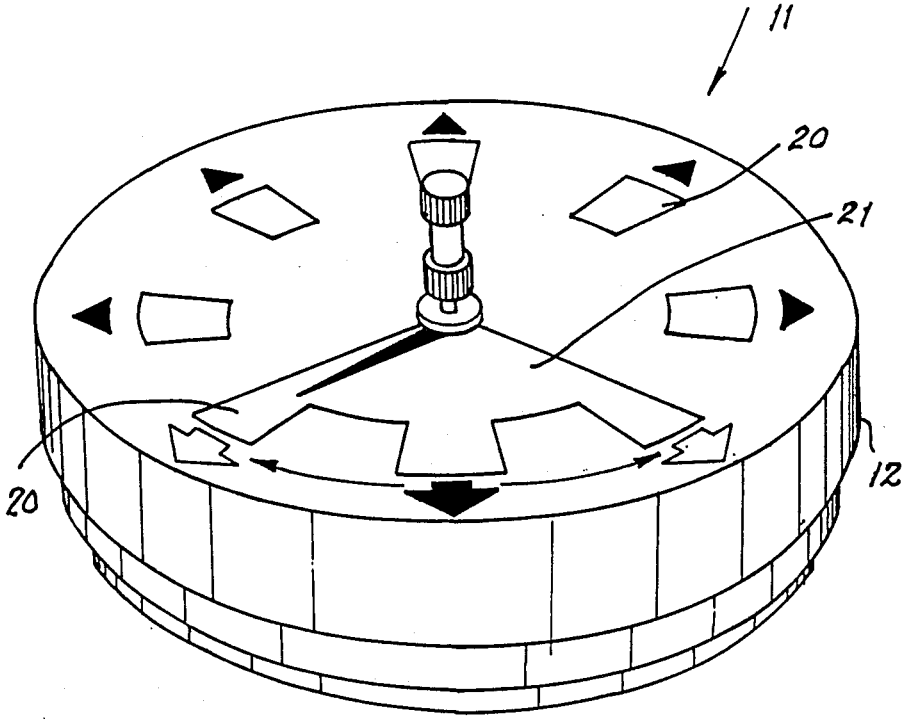
FIG. 5 is an isometric view of the game playing move selector.

The game playing move selector 11 discussed above is used in association with a game playing board 60 as shown at FIG. 4 which defines a triangular course 62 having three arms 26, 27, 28. Arm 26 may be thought of as the base and arms 27, 28 may be thought of as the legs of the triangular course. In the embodiment illustrated, one token must move from a start line at one side of the base of the triangle around circled reference points 1, 2, 3, 4 and 5, designated by reference numeral 29, which are intended to represent the marker buoys of a yacht course from the start line to the finish line, at the other end of the base. The number of times the token is required to pass along the various arms of the triangle depends upon the nature of the course set at the beginning of the game, movement being possible in both clockwise and counterclockwise directions around the course. Each arm defines a longitudinal axis along its length, arm 26 defining axis 70, arm 27 defining axis 72 and arm 28 defining axis 74. Movement parallel to each axis is therefore inherently along a general direction of movement for each arm. In its passage along the long arms of the triangle the token will move in the general direction defined by each arm according to the sequential course set for each game at the start. The degree of movement token during any one "throw" is defined by a plurality of movement stations 30 which are defined by equidistant dots located around the triangular course. The movement stations 30 are interconnected by a plurality of straight lines, most of which define three or more specific directions of movement that a playing piece can travel in its movements from one station to another. The outermost stations along the edges may limit movement of the playing piece to one or two specific directions of travel.

Figure 1:
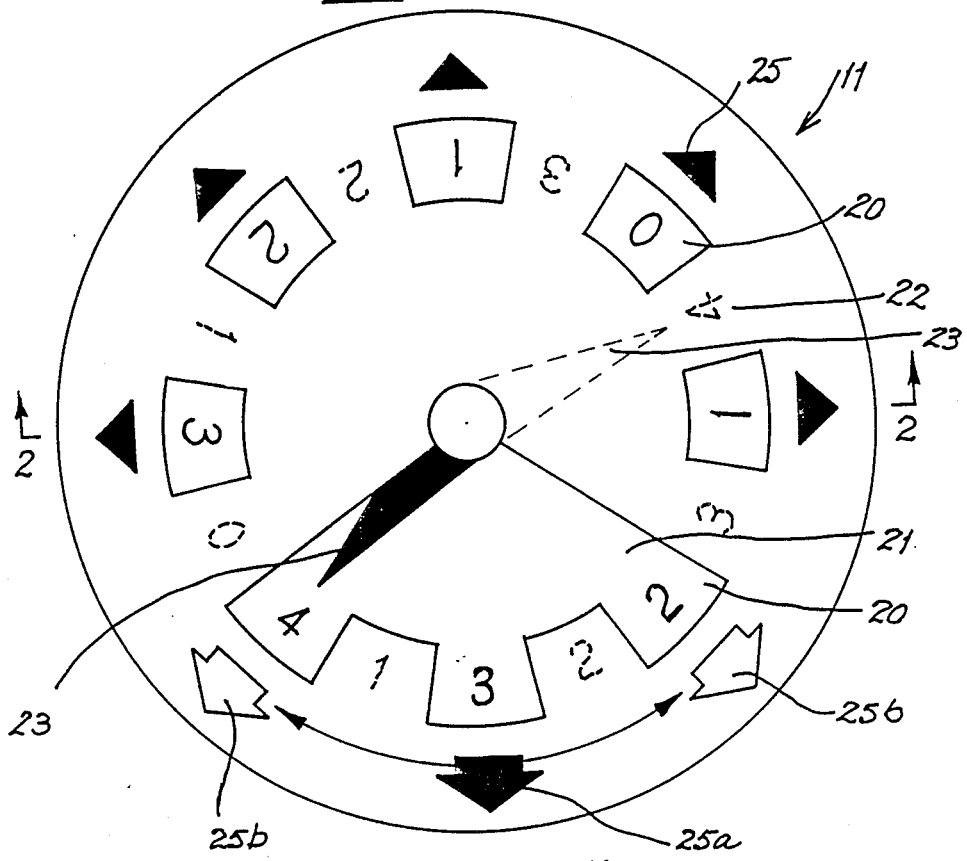
FIG. 1 is a plan view of the face of the game playing move selector of the embodiment.
Figure 3:
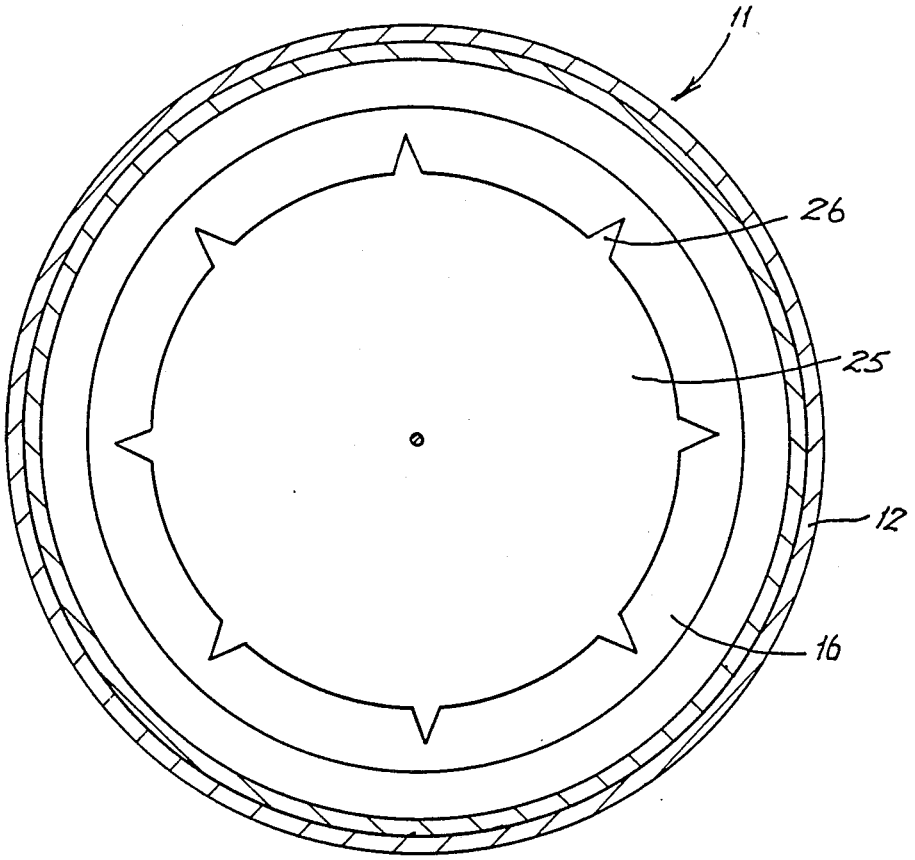
FIG. 3 is a sectional view of a game playing move selector along line 3—3 of FIG. 2.

The game playing move selector 11 of FIGS. 1 to 3 may be used to control the movements of a token about the course whereby the game playing move selector is located upon a board and the most significant arrow like indicia 25*a* on the mask 15 is positioned to indicate the wind direction according to the course set for the game. The less significant indicia 25*b* serve to provide an indication of possible wind shifts from the main wind direction indicated by the most significant indicia 25*a*. For purposes of illustration, each of the indicia 25, 25*a* and 25*b* has been separately labeled in FIG. 4 by upper case letters A through H, representing directions of movement for each of the windows. Letter A corresponds to indicia 25*a*, letters B and H correspond to indicia 25*b*. One of the arrows 23 is also shown. Due to the biasing means of the move selector, as explained above, one of the arrows 23 will always appear in window or cut-out 21 when spinning stops. Chance will determine which one of the arrows 23 will so stop as to be visible through cut-out 21. The game playing move selector 11 is located on the game playing board 60 such that the most significant arrow like indicia 25*a* is directed in the direction of one of the general directions of movement of the arms of the playing board. Accordingly, directions/positions A and E can be aligned parallel with any of the axes 70, 72 and 74. Moreover, the positions A and E may be reversed, when so aligned. The relative orientation of the move selector in FIG. 4 is illustrative only, and the game is operable in any of the various orientations which correspond to alignment of A and E with the general direction of movement of any arm. On the spinning of the disc 16, the disc will eventually come to rest such that one of the second indicia 23 is visible in the second window 21 to indicate whether the wind for the particular move is directed in the general direction of travel or there has been a wind shift to either side of the general direction of travel. In moving the token, the number of spaces which can be moved may be selected from one of three of the first set of windows 20 which correspond to the three specific directions of movement for the respective arm 26, 27 or 28 of the triangle on which the token is located. For instance reference is made to FIG. 4 and it is taken that movement is clockwise and the token is located at dot 84 on the second arm 27. The second indicia is directed in the direction of the most significant arrow-like device 25*a*. The player can move from dot 84 in the general direction (or F) of that arm one space, in the specific G direction (to the right of the general direction) two spaces, and in the E direction (to the left of the general direction) zero spaces. Movement directly into the wind is impossible. From dot 82 in arm 26, the player can move in the general (or A) direction four spaces, the H or B directions three spaces or the C and G directions two spaces. Movement with a rearward component is a matter of rules, rather than structural limitation. From dot 80 in arm 28, the player can move three spaces in the general (or H) direction, four spaces in the A direction and zero spaces in the E direction. It can be appreciated that magnitude of movement is tied to wind direction in a way which simulates real sailing. Therefore, with each spin of the disc 16 a different wind direction is selected for the player from which the player may select three specific directions of movement and then move in each direction a number of spaces as indicated in the relevant set of windows for the respective arms 26, 27 or 28 on which the token is located.

At various locations around the course defined by the arms 26, 27 and 28 there are a variety of hazards which may include strong currents as designated in regions 31 or by reefs or like navigational hazards located in the course which must be avoided.

Figure 6:
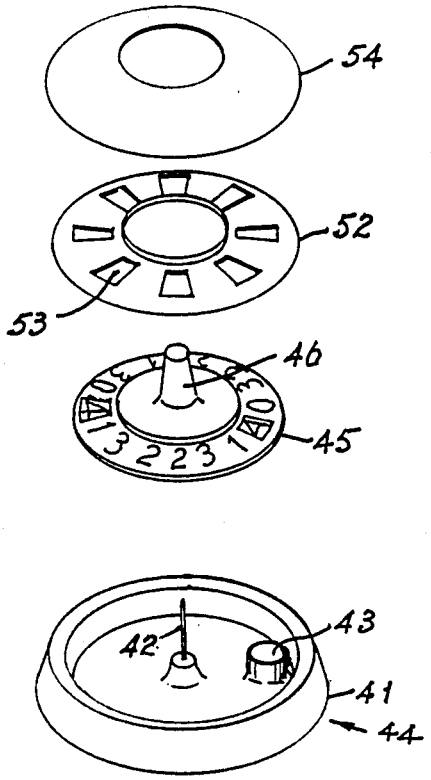
FIG. 6 is an exploded view of a second form of selector.
Figure 7:
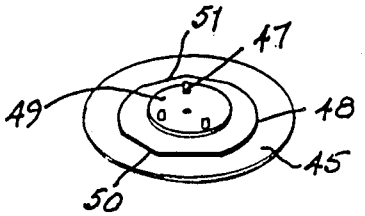
FIG. 7 is a view of the underside of the spinner assembly used in the embodiment of FIG. 6.

In the embodiment of the invention shown in FIGS. 6 and 7 of the drawing the selector comprises a cylindrical housing 41 open at the top and provided with an upwardly projecting spindle 42 and a small recess 43 in which a permanent magnet is secured. A small arrow (not shown) formed integrally with the housing is provided at the base of housing in alignment with the magnet. A spinner assembly is rotatably mounted on the spindle. The spinner assembly comprises a disc 45 having a series of numerals marked around its periphery and a hat shaped finger grip 46 the base of which is provided with a series of projections 47 which pass through holes formed in the disc and through holes formed in a metal plate 48 and through a locking disc 49. The metal plate 48 is more or less circular with a number of straight edges which serve to define projecting points 50 and 51. The plate is so dimensioned that the points 50 and 51 pass over the magnet recess 43. A mask 52 provided with a series of windows 53 is positioned over spinner assembly and the mask covered with a transparent cover 54 the periphery of which engages the upper periphery of the housing.

The selector is used in a manner similar to the selector of the first embodiment. The arrow is placed in the direction which the player wishes to go. The spinner assembly is then rotated and when it comes to a stop one of the two 4's on the disc 49 will appear in the window aligned with the arrow or in one of the windows on either side. The player then views the window which is aligned with the direction and in which the player wishes to go and the window on either side thereof.

It should be appreciated that the scope of the present invention need not be limited to the particular scope of the embodiments described above and in particular need not be limited to the particular applications described above. In particular if desired the apparatus may be used in association with a game to simulate any other form of sport where it is necessary for the player to choose both a direction and a distance to be travelled at each throw.

What is claimed is:

1. A move selector for playing a game simulating a yacht race, the move selector comprising:

a housing having a spindle with an upright axis;

a disc mounted on the spindle within the housing for rotation about the upright axis, thereby defining an upper face of the disc;

first and second circular arrays of numeric indicia provided on the upper face of the disc, the numeric indicia of each array being angularly equidistant from each other and disposed between adjacent numeric indicia of the other array, the numeric indicia of each array being identical in sequence but offset from one another in opposed relation, each of the circular arrays having associated with it a directed arrow-like indicia extending radially outwardly in alignment with one of the numeric indicia of its respective array;

a cover for the housing, the cover having a set of angularly equidistant and transparent first windows with which each of the first and second circular arrays of numeric indicia is alignable exclusive of the other array and a second transparent window associated with three adjacent of the first windows, said three adjacent first windows defining three positions with which each of the directed arrow-like indicia is alignable exclusive of the other arrow-like indicia; and, biasing means for controllably stopping rotation of the disc relative to the cover, such that one of the first and second circular arrays of numeric indicia will become visible through the first set of windows when the respective directed arrow-like indicia and its aligned numeric indicia of its respective array becomes visible through the second window at one of said three positions, whereby the move selector may be used to randomly simulate random wind directions for a game simulating a yacht race and weighted magnitudes of movement for a plurality of directions of movement based upon the numeric indicia and corresponding to the randomly selected wind direction.

2. A move selector as claimed in claim 1, wherein the biasing means comprises:

a first element supported by one of the housing and the disc, and spaced from the axis of rotation; and, a plurality of second elements supported on the other one of the disc and the housing, and spaced from the axis of rotation, the number of second elements being equal to the number of the numeric indicia of both circular arrays, the first and second elements being, respectively, magnetically attractive.

3. A move selector as claimed in claim 2, wherein the second element comprises a plurality of protrusions on the periphery of a circular disc of magnetically attractive metal, the protrusions passing in close proximity to the first element when the disc of numeric indicia is rotated.

4. A move selector as claimed in claim 3, wherein the disc of numeric indicia is formed from the circular disc of magnetically attractive metal.

5. A game playing apparatus for stimulating a yacht race, the apparatus comprising:

a move selector, comprising:

a housing having a spindle with an upright axis;

a disc mounted on the spindle within the housing for rotation about the upright axis, thereby defining an upper face of the disc;

first and second circular arrays of numeric indicia provided on the upper face of the disc, the numeric indicia of each array being angularly equidistant from each other and disposed between adjacent numeric indicia of the other array, the numeric indicia of each array being identical in sequence but offset from one another in opposed relation, each of the circular arrays having associated with it a directed arrow-like indicia extending radially outwardly in alignment with one of the numeric indicia of its respective array;

a cover for the housing, the cover having a set of angularly equidistant and transparent first windows with which each of the first and second circular arrays of numeric indicia is alignable exclusive of the other array and a second transparent window associated with three adjacent of the first windows, said three adjacent first windows defining three positions with which each of the directed arrow-like indicia is alignable exclusive of the other arrow-like indicia; and, biasing means for controllably stopping rotation of the disc relative to the cover, such that one of the first and second circular arrays of numeric indicia will become visible through the first set of windows when the respective directed arrow-like indicia and its aligned numeric indicia of its respective array becomes visible through the second window at one of said three positions; and at least one token; and, a game board defining a course of movement from a starting point to a finishing point by a plurality of movement stations, the movement stations defining a number of specific directions of movement between the movement stations, the move selector randomly simulating wind directions based upon the arrow-like indicia and providing weighted magnitudes of movement for a plurality of selectable directions of movement based upon the numeric indicia and corresponding to the randomly selected wind direction.

* * * * *